United States Patent [19]

McIntosh

[11] 3,970,543

[45] July 20, 1976

[54] PRODUCTION OF LUBRICATING OILS

[75] Inventor: Herbert A. McIntosh, Houston, Tex.

[73] Assignee: Texaco Inc., New York, N.Y.

[22] Filed: Oct. 2, 1974

[21] Appl. No.: 511,132

Related U.S. Application Data

[63] Continuation of Ser. No. 302,166, Oct. 30, 1972, abandoned.

[52] U.S. Cl. ..... 208/86; 208/87; 208/96; 208/144; 208/211; 208/212

[51] Int. Cl.[2] ..... C10G 21/00; C10G 23/00

[58] Field of Search ..... 208/89, 212, 218, 211, 208/216, 111, 86, 87, 96, 144

[56] References Cited

UNITED STATES PATENTS

| | | | |
|---|---|---|---|
| 3,150,077 | 9/1964 | Cole et al. | 208/216 |
| 3,256,175 | 6/1966 | Kozlowski et al. | 208/216 |
| 3,481,863 | 12/1969 | Donaldson et al. | 208/211 |
| 3,516,925 | 6/1970 | Lawrence et al. | 208/111 |

*Primary Examiner*—G. J. Crasanakis
*Attorney, Agent, or Firm*—T. H. Whaley; C. G. Ries; Robert Knox, Jr.

[57] ABSTRACT

Lubricating oils are prepared by a sequence of steps comprising hydrorefining, fractionation and blending.

8 Claims, No Drawings

PRODUCTION OF LUBRICATING OILS

This is a continuation of application Ser. No. 302,166, filed Oct. 30, 1972, now abandoned.

This invention relates to the production of lubricating oils. More particularly, it is concerned with the production of lubricating oils of high viscosity index in improved yields.

Various procedures for the refining of lubricating oils such as distillation, solvent refining, hydrorefining, solvent dewaxing, acid treating, clay contacting and hydrofining are well known. When residual type oils are used, a preliminary deasphalting step is also generally required. In the processing steps listed above, distillation is employed as a means of separating the crude oil into fractions of varying viscosities. Solvent refining with, for example, furfural or sulfur dioxide is ordinarily used as the means of removing aromatic compounds to improve the viscosity index. Hydrorefining has been suggested as a substitute for solvent refining in that it effects a reduction of the aromatic content of the oil by hydrogenation of the aromatic rings. It also effects a lowering of the average molecular weight of the crude lube oil. Solvent dewaxing using, for example, a mixture of a low molecular weight ketone, e.g., methyl ethyl ketone and an aromatic compound such as benzene or toluene is used to improve the pour point of the oil and clay contacting is used generally as a final step to further improve the color and to neutralize the oil after acid treating. Hydrofinishing which is a mild catalytic hydrogenation has also been suggested as a substitute for clay contacting.

In a typical operation the crude oil is distilled under subatmospheric pressure to produce lube oil distillates and a vacuum residuum, the distillates are solvent refined or hydrorefined and then solvent dewaxed and finished either by clay contacting or hydrofinishing. The residuum is deasphalted and subjected to substantially the same treatment.

In each of the process steps listed above, each takes it toll of the ultimate yield of refined lube oil product. For example, the production of 10,000 barrels of a lubricating oil ordinarily may take about 33,400 barrels of a vacuum residuum. In the deasphalting step, the yield of deasphalted residuum usually amounts to about 80 percent of the charge. Hydrorefining of the deasphalted residuum can be expected to result in a yield of a lubricating oil of about 53.5 percent. A further loss is sustained in solvent dewaxing of the hydrorefined lube oil whereby a solvent dewaxing yield of about 70 percent is obtained. This in effect results in a product lube oil yield of about 33 percent based on the charge. It will be appreciated that more severe treatment in any or all of these steps would result in an even greater loss in yield.

It is, therefore, an object of the present invention to produce lubricating oils of high viscosity index. Another object of the invention is to produce lubricating oils having properties substantially equivalent to those obtained by conventional means wherein a refined lube oil can be obtained in greater yields. These and other objects will be obvious to those skilled in the art from the following disclosure.

According to the process of my invention, improved lubricating oils are produced by hydrorefining a crude lubricating oil, separating the hydrorefining zone effluent into a gas rich in hydrogen, a hydrocarbon fraction having an end boiling point of between about 600° and 650°F., a second hydrocarbon fraction having an initial boiling point between about 600° and 650°F. and an end boiling point between about 800° and 850°F. and a residual fraction boiling above about 800°–850°F. and adding to said residual fraction a fresh oil having a boiling range substantially the same as said second fraction.

The feed to the process of my invention can be any crude lubricating oil fraction such as deasphalted residue, heavy distillates and mixtures thereof. The feed is first subjected to hydrorefining whereby a substantial portion of the aromatic compounds present in the feed are converted to more saturated compounds and wherein there is considerable molecular rearrangement with some cracking taking place such that the average molecular weight of the product is lower than the average molecular weight of the feed.

The hydrorefining is effected, in a preferred embodiment, by passing the feed into contact with a fixed bed of hydrorefining catalyst at a temperature between about 600° and 900°F., a pressure between about 800 and 5000 psig, a space velocity of about 0.1–5.0 barrels of oil per barrel of catalyst per hour with hydrogen being introduced at a rate between 1000 and 20,000 standard cubic feed per barrel of charge. Preferably, the temperature is maintained within the range of 650°–850°F., the pressure between 1000 and 3000 psig, the space velocity between 0.15 and 1.5 v/v/hr and the hydrogen rate between 3000 and 10,000 scfb.

The hydrogen used in the process need not necessarily be pure. Hydrogen having a purity of at least 65 percent and preferably at least 70 percent may be used. Electrolytic hydrogen, hydrogen produced as a by-product from the catalytic reforming of naphtha, and hydrogen produced by the partial oxidation of a hydrocarbonaceous material followed by shift conversion and $CO_2$ removal are satisfactory.

The catalyst used in the hydrorefining step comprises a hydrogenating component carried on a support. The hydrogenating component suitably is composed of a Group VIII metal or compound thereof preferably in admixture with a Group VI metal or compound thereof. Examples of Group VIII metals are iron, cobalt and nickel and of Group VI metals, molybdenum and tungsten. The hydrogenating component is ordinarily in the form of the oxide when charged to the reaction zone. If desired, the catalyst may be sulfided prior to use by contact with a sulfiding agent such as $H_2S$, methyl mercaptan and the like.

The iron group metal should be present in an amount between 2 and 40 percent preferably between 2 and 12 percent based on the total weight of the catalyst composite. When a Group VI metal is present, it is ordinarily present in an amount between about 5 and 40 percent based by weight of the catalyst composite, the preferred range being from 10–30 wt. %.

The catalyst support comprises a refractory inorganic oxide such as alumina, silica, zirconia, magnesia and mixtures thereof. Preferably in the case of distillate feed the support is composed primarily of alumina and contains about 2–15 percent silica. When the feed is a deasphalted residuum, the support may also contain from about 5–45 wt. % of a crystalline zeolite having uniform pore openings of from 6-15A such as faujasite or zeolite Y and having a reduced alkali metal content. Such zeolites may be prepared in a manner well-known in the art whereby the alkali metal present in the natural or synthetic zeolite is removed and replaced by hydrogen or a rare earth metal. In addition, the zeolite-containing support should also include an amorphous refractory inorganic oxide such as alumina, silica, magnesia, zirconia and the like or mixtures thereof preferably mixtures of alumina and silica. The catalyst may be in the form of a fixed bed, a moving bed or a slurry, a preferred embodiment being a fixed bed of particulate catalyst. The reactant flow may be upward or downward or the feed may be passed through the reaction zone in a direction countercurrent to the hydrogen. Preferably, the hydrogen and feed are both passed downwardly through a fixed bed of pelleted catalyst.

The effluent from the hydrorefining zone is passed to a high pressure separation zone from which a gas rich in hydrogen is removed and advantageously is recycled to the hydrorefining zone. To prevent the buildup of impurities, a portion of the recycled hydrogen may be bled from the system and replaced with fresh hydrogen. The recycled hydrogen may also be subjected to purification treatment as by scrubbing with, for example, water or diethanolamine or acid solutions. The balance of the effluent from the hydrorefining zone is then separated into a hydrocarbon fraction of relatively low boiling hydrocarbons, that is, those hydrocarbons boiling up to about 600°–650°F. as is done in conventional refining practice. The remainder of the effluent from the hydrorefining zone, that is, the remaining lube oil fraction having an initial boiling point of about 600°–650°F. is then subjected to additional fractionation to remove therefrom a second hydrocarbon fraction having an end boiling point of about 800°–850°F. This second hydrocarbon fraction is replaced by a fraction of substantially the same boiling range in an amount between about 50 percent and 200 percent by volume of the second fraction, which has been obtained from a virgin distillate and which in a specific embodiment has been solvent refined for the removal of aromatics. Advantageously, this fresh oil is derived from the same crude as the original charge. In this connection, the term fresh oil is intended to denote oil which has not been hydrorefined or hydrocracked. In a preferred embodiment, the fresh oil is added in an amount substantially equal to that of the second fraction.

The mixture of fresh oil and hydrorefined oil may then be subjected to dewaxing to lower the pour point. In one embodiment of the invention the oil is contacted with a dewaxing agent such as a mixture containing about 40–60 volume % of a low molecular weight ketone containing from 3–9 C atoms such as acetone, methyl ethyl ketone or normal butyl ketone and 60–40 volume % of a monocyclic aromatic compound such as benzene or toluene in a ratio of about 3–4 parts by volume of solvent per volume of oil, the mixture cooled to a temperature of about 0° to −20°F. and the waxy component removed by filtration or centrifuging. The filtrate or supernatant liquid is then subjected to flash distillation and stripping to remove residual solvent.

Alternatively, the dewaxing may be effected by passing the hydrorefined oil or its mixture with the fresh oil into contact with a catalyst comprising a hydrogenating component such as is used in the hydrorefining catalyst supported on a decationized mordenite. Preferably the support is made by treating a synthetic mordenite with acid such as 6N HCl to reduce the alkali metal content and to replace the alkali metal ions with the hydrogen ions. For increased activity the mordenite is treated with acid to the extent that a portion of the alumina is leached out to produce a mordenite having a silica:alumina mol ratio of at least 20. The catalytic dewaxing is carried out by bringing the oil into contact with a bed of the catalyst at a temperature of at least 450°F., a pressure of at least 100 psig, a space velocity of from about 0.2 to 4.0 v/v/hr. and a hydrogen rate of about 1000–10,000 scfb. Preferred conditions are a temperature between 450° and 850°F., a pressure between 100 and 1500 psig, a space velocity of 0.2 and 2.0 and a hydrogen rate between 1200 and 5000 scfb.

The fresh oil and the residual lube oil cut may be solvent refined and dewaxed separately and then blended or the blending may take place prior to the dewaxing and/or solvent refining. For example, the vacuum residuum may be deasphalted, hydrorefined and the hydrorefined lube oil solvent dewaxed. The fresh oil can be solvent refined and either separately dewaxed or blended with the hydrorefined oil and the blend dewaxed. In the alternative, particularly if a product stable to ultraviolet light is desired the hydrorefined oil may be solvent refined separately or blended with the fresh oil and the blend solvent refined and dewaxed. If solvent refined separately, the fresh oil and the hydrorefined oil may be blended before or after solvent dewaxing.

The amount of 600°–650°F. to 800°–850°F. fraction present in the hydrorefining zone effluent will vary depending on the charge stock and the severity of the hydrorefining reaction conditions. Ordinarily, it will range between about 5 and 30 volume % of the effluent boiling above 600°–650°F.

In the following examples which is presented for illustrative purposes only, the feed is a deasphalted residium having the following characteristics:

TABLE I

| | |
|---|---|
| Gravity, °API | 22.1 |
| Viscosity, SUS/210°F. | 187.6 |
| Viscosity Index | 80 |
| Carbon Residue, wt. % | 2.22 |
| Sulfur, wt. % | 0.36 |
| Basic Nitrogen, ppm | 370 |
| Total Nitrogen, ppm | 1007 |

The hydrorefining catalyst has the following specifications:

TABLE II

| | |
|---|---|
| Cobalt, wt. % | 2.3 |
| Molybdenum, wt. % | 10.3 |
| Alumina, wt. % | 79.7 |
| Silica, wt. % | 3.9 |
| Surface Area, $m^2/g$ | 290 |
| Pore Volume, cc/g | 0.63 |

The processing conditions in the hydrorefining reactor are as follows:

TABLE III

| | |
|---|---|
| Temperature, °F. | 815 |
| Space Velocity, v/v/hr | 0.5 |
| Hydrogen Rate, scfb. | 5000 |
| Hydrogen Partial Pressure, psig. | 1500 |

In the solvent refining step the solvent is N methyl-2-pyrollidone and is used at a dilution of 100 volume % at a temperature of 170°F. Solvent dewaxing is effected using a mixture of equal parts by volume of methyl ethyl ketone and toluene using two parts of solvent per part of oil and filtering at a temperature of −15°F.

EXAMPLE I

The charge, obtained from a vacuum residuum in 80% yield by propane deasphalting at a dosage of 775 volume % and a temperature of 145°F., is hydrorefined under the conditions specified above by being passed downwardly with hydrogen through a fixed bed of pelleted catalyst and the material boiling below 625°F is removed from the effluent. The balance of the effluent, a lubricating oil having an IBP of about 625°F., has the following properties:

TABLE IV

| | |
|---|---|
| Gravity, °API | 30.1 |
| Viscosity, SUS/210°F. | 49.7 |
| Viscosity Index | 121 |

EXAMPLE II

This example is an extension of Example I in which the 625°F.+ portion of the hydrorefining zone effluent is fractionated to remove the fraction boiling between 625° and 825°F. amounting to about 10.5 percent by volume of the 625°F.+ fraction. An equal amount of a 625°–825°F. solvent refined light oil fraction obtained from the same crude as the feed is added to the 825°F.+ portion of the effluent. Data on the light oil and the blend appear below:

TABLE V

| | Light Oil | Blend |
|---|---|---|
| Gravity, °API | 35.5 | 34.7 |
| Viscosity, SUS/210°F. | 38.2 | 50.5 |
| Viscosity Index | 110 | 131 |

These data show that by removing the light portion of the hydrocracked oil and replacing it with an unhydrocracked light oil of essentially the same boiling range results in a lubricating oil blend of much higher viscosity index. It will also be noted that the viscosity index of the blend is higher than the viscosity index of either of the components. Example II also represents an increase in yield as, by the procedure of Example 1, 33,378 barrels of residuum are required by deasphalting, hydrorefining and also solvent dewaxing to produce 10,000 barrels of 0°F. pour point oil having a viscosity index of 115 whereas by the procedure of Example II followed by solvent dewaxing 30,788 barrels of residuum and 2151 barrels of the straight run 625°–825°F. cut yields a substantially equivalent product in both yield and quality.

These examples show that by the process of this invention, a lube oil can be obtained having a higher viscosity index than one obtained from the same source by prior art procedures and in greater yield. The yield can be even greater if a lesser increase in viscosity index is satisfactory by operating the various steps at milder conditions.

Obviously, various modifications of the invention as hereinbefore set forth may be made without departing from the spirit and scope thereof, and therefore, only such limitations should be made as are indicated in the appended claims.

I claim:

1. A process for the production of a lube blend of improved viscosity index which comprises subjecting a crude petroleum oil to distillation to produce a light lube oil distillate having an initial boiling point between about 600° and 650°F. and an end point between about 800° and 850°F. and a residual fraction having an initial boiling point between about 800° and 850°F., separating said residual fraction into a heavy crude distillate and a vacuum residuum, deasphalting said vacuum residuum, passing a member of the group consisting of said heavy crude distillate and said deasphalted residuum into contact with a hydrorefining catalyst at a temperature between about 600° and 900°F., a pressure between about 800 and 5000 psig and a space velocity between about 0.1 and 5 v/v/hr. in the presence of added hydrogen, separating the hydrorefining zone effluent into a gas rich in hydrogen, a fraction having an end point between about 600° and 650°F. and a hydrorefined lube oil fraction having an initial boiling point between about 600° and 650°F., separating from said hydrorefined lube oil fraction a light hydrorefined fraction having an initial boiling point between 600° and 650°F. and an end point between about 800° and 850°F. and blending with said hydrorefined lube oil fraction having an initial boiling point between about 800° and 850°F. said light lube oil distillate in an amount between 50 and 200 percent by volume of said light hydrorefined fraction to produce a lube oil blend having a viscosity index higher than either said hydrorefined lube oil fraction or said light lube oil distillate.

2. The process of claim 1 in which the feed to the hydrorefining zone is said heavy crude distillate.

3. The process of claim 1 in which the feed to the hydrorefining zone is said deasphalted vacuum residuum.

4. The process of claim 1 in which said light lube oil distillate has a viscosity SUS/210°F. between 30 and 50.

5. The process of claim 1 in which said light lube oil distillate is solvent refined prior to the blending.

6. The process of claim 1 in which the blend is dewaxed by contact with a solvent mixture comprising a ketone having from 3 to 9 carbon atoms and a monocyclic aromatic hydrocarbon.

7. The process of claim 1 in which the blend is dewaxed by being contacted with a mordenite-containing catalyst under wax-cracking conditions.

8. The process of claim 1 in which the blend is solvent-refined by contact with furfural.

* * * * *